US005502992A

United States Patent [19]

Sörgel et al.

[11] Patent Number: 5,502,992

[45] Date of Patent: Apr. 2, 1996

[54] REGULATION SYSTEM IN THE MANUFACTURE OF HOT ROLLED STRIPS BY MEANS OF A MULTI-STAND HOT ROLLING MILL

[75] Inventors: Günter Sörgel, Nürnberg; Friedemann Schmid, Erlangen, both of Germany

[73] Assignee: Siemens Aktiengesellshaft, München, Germany

[21] Appl. No.: 170,230

[22] PCT Filed: Jun. 16, 1992

[86] PCT No.: PCT/EP92/01364

§ 371 Date: Dec. 28, 1993

§ 102(e) Date: Dec. 28, 1993

[87] PCT Pub. No.: WO93/00181

PCT Pub. Date: Jan. 7, 1993

[30] Foreign Application Priority Data

Jun. 28, 1991 [EP] European Pat. Off. ..... 91110753

[51] Int. Cl.[6] ..... B21B 37/00

[52] U.S. Cl. ..... 72/8; 72/234; 72/9.2; 72/10.1; 72/11

[58] Field of Search ..... 72/6–8, 11, 20, 72/21, 234, 365.2; 364/472

[56] References Cited

U.S. PATENT DOCUMENTS

| | | | |
|---|---|---|---|
| 3,552,162 | 1/1971 | Gingher, Jr. et al. | 72/8 |
| 3,592,031 | 7/1971 | Sutton et al. | 72/8 |
| 3,820,711 | 6/1974 | Economopoulos et al. . | |
| 3,882,709 | 5/1975 | Kawamoto et al. | 72/234 |
| 4,711,109 | 12/1987 | Rohde et al. | 72/17 |

FOREIGN PATENT DOCUMENTS

| | | |
|---|---|---|
| 0173045 | 3/1986 | European Pat. Off. . |
| 0121148 | 2/1989 | European Pat. Off. . |
| 2106848 | 10/1971 | Germany . |
| 2736234 | 2/1978 | Germany . |

OTHER PUBLICATIONS

International Federation of Automatic Control, Proceedings of the IFAC, 6th World Congress; Boston, 24–30 Aug. 1975; Instrument Society of America, Pittsburgh, Pennsylvania, US, 1975; Part 2—Applications; Session 46.1, pp. 1–8; H. W. Seyfried et al., *Application of Adaptive Control in Rolling Mill Area, Especially for Plate Mills.*

*Primary Examiner*—Lowell A. Larson
*Assistant Examiner*—Thomas C. Schoeffler
*Attorney, Agent, or Firm*—Kenyon & Kenyon

[57] ABSTRACT

The invention relates to control in the manufacture of hot strip by means of a multi-stand hot-strip rolling mill, especially a wide-strip rolling mill, which has a higher-order process control system with a sampling plan with the initial and final dimensions, with material data, rolling temperatures, etc., and a guidance system for setpoint control of lower-order decoupled individual regulators for the variable functional parameters of the individual roll stands, e.g. roll adjustment, rotational speed, torque, etc., with the setpoints of the individual regulators being determined by means of a computation process using model equations with convergent parameter adjustment to the actual parameters, in such fashion that a working point control that can be determined in advance is provided and section control and regulation are accomplished by changing the load distribution on the individual stands in such fashion that the working points lie in the previously determined tolerance range of a shape control line.

13 Claims, 2 Drawing Sheets

REGULATION SYSTEM IN THE MANUFACTURE OF HOT ROLLED STRIPS BY MEANS OF A MULTI-STAND HOT ROLLING MILL

BACKGROUND OF THE INVENTION

The present invention relates to a controller for controlling the manufacturing of hot strip using a multi-stand hot-strip rolling mill, and, in particular, a wide-strip mill. A sampling plan including initial and final measurements, material data, rolling temperatures, etc. is provided. A control system for controlling the setpoint of lower-order coupled individual controllers for the variable functional parameters of the individual stands (e.g. roll adjustment, rotational speed, torque, etc.) is also provided. In the present invention the setpoints of the individual controllers are computed using model equations involving convergent parameter adjustment to the actual parameters such that setpoint control, that can be predetermined, is obtained.

In hot-strip rolling mills, producing a strip having a required section development and flatness by means of a small number of simple rolling mill stands, without requiring costly mechanical roll actuators is desired. If the need for roll actuators is unavoidable, these actuators should be simple and limited to only a few rolling mill stands. Particularly, in hot wide-strip mill trains designed according to these criteria, there was formerly no way to optimize the thickness section of the strip. A sampling plan design based on experiential values continues to be the norm.

The European Patent Application EP-0 121 148 B1 discusses a section and flatness control for hot-strip tandem mill trains in which the strip section at the critical thickness (below which no significant reshaping of the rolled strip can be achieved) is used as the basis of an expensive flatness and section development control of the hot strip. An equivalent control is disclosed in the German Patent Application DE-27 36 234 A2. Rolling mill trains with the above mentioned controls require a plurality of thickness, section, and flatness measuring devices along the mill train and expensive stand controls. As a result, the total cost of a hot strip whose production is controlled in this fashion is high. This is especially true when a wide strip rolling train is used. Further, both the measured values and the roll actuators are costly to maintain and significantly increase operating expenses.

The goal of the present invention is to provide a control for controlling the manufacturing of hot strip with a multiple-stand hot-strip rolling mill, and in particular, a wide-strip mill. The control of the present invention permits the mill to produce rolled strip within tolerance by employing model calculations, especially with the aid of automatically adaptable model calculations. Hence, the control of the present invention requires only a minimum of expense. In particular, old rolling mill trains can be modernized with the control according to the present invention without having to rebuild the rolling mill trains and without needing to provide the rolling mill trains with a plurality of expensive measuring devices and actuators on the roll stands.

SUMMARY OF THE INVENTION

The present invention realizes the above mentioned goal by providing section control and regulation that uses changes in the load distribution on the individual stands such that their working points lie within a "shape funnel" defined by the predetermined tolerance range of a section control line. Using a computation technique in which the rolling mill engineer has considerable confidence because of long years of experience, it is possible to achieve the required section and flatness values with simple rolling mill technology, primarily only by influencing the principal influential parameter in the rolling process, i.e., the distribution of the required total roll separating force over the individual stands. The present invention achieves the correct load distribution by using a shape control line for the required adaptation model. Together with other measures which cooperate with the primary control measure of suitable load distribution, the required section is obtained for strips with different rolling temperatures, section designs, final thicknesses, etc. Thus, the regulating and calculating technique according to the present invention can significantly reduce the "hardware" expense in rolling technology while simultaneously increasing flexibility.

The design of the present invention provides that the tolerance range of the shape control lines, which is surprisingly present and can be utilized, is smaller (deviation angle $\beta$) below the critical thickness (below which a relative section constancy is obtained) and is larger (deviation angle $\alpha$) above the critical thickness. Thus, the physical conditions on a rolling mill train can be advantageously used to achieve regulation and computation optimization and not merely positioning on a line determined in advance.

In another embodiment of the present invention, a "shape funnel" defined by the tolerance range of the shape control lines, with transitions for the limits of $\beta$ and $\alpha$ is obtained in the area of the critical thickness. In this embodiment, the shape funnel is made symmetrical to the shape control lines below the critical thickness and asymmetrical above the critical thickness in the area of the deviation angle, especially in a ratio of 2:1, between the area above and below the shape control lines. Thus an optimization range adjusted for the physical realities in the rolling mill for the load distribution calculation in which the shape control line can be pivoted or changed in another way is simply obtained. Within the shape funnel, the optimization computer rapidly calculates the load distribution possibilities for rolling and can shed some light on the question of whether, and at what load distribution, the required section can be reached at a specified thickness or whether the specified thickness or section cannot be obtained in this way for a particular rolling mill train. When the calculation of the optimization computer indicates that the specified section or specified thickness cannot be achieved, boundary conditions may have to be changed or additional actuators must be provided and installed for the roll stands. Influencing the section and the final thickness using roll actuators are known to the rolling mill engineer.

To calculate the shape control lines, the data from the specified section of the strip produced are used. When the calculation yields working points outside the shape flannel, a recalculation takes place with new load distribution assumptions until all the working points lie in the shape funnel. When the optimization calculation indicates that in addition to changing the load distribution on the individual stands, additional factors must act on the rolling process to maintain the tolerance range of the shape control lines, this is advantageously accomplished by influencing the roll re-deflection, the roll shift, and/or roll transposition, and/or by influencing the thermal convexity, possibly by cooling or even by hydraulic or thermal influence. A change in the roll microsection can also result as a consequence of the optimization calculation in conjunction with the shape funnel. It is advantageous in this regard constantly to compensate for the factors that influence roll wear.

DETAILED DESCRIPTION

Figure 1:
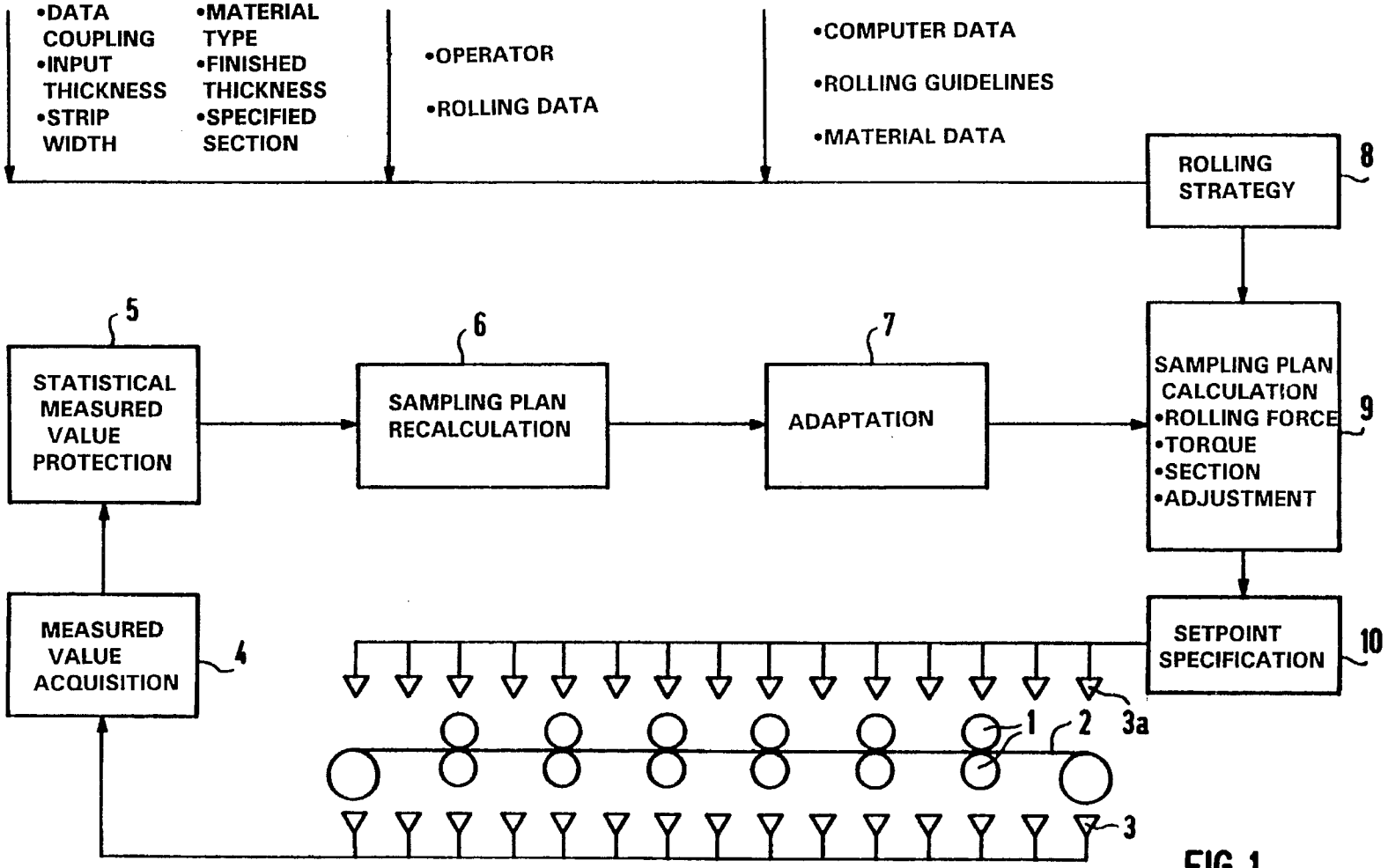
FIG. 1 is a schematic representation of a rolling mill train showing the regulating structure and the most important individual parameters.

In FIG. 1, reference 1 refers to the rolls of the individual stands of a rolling mill train, 2 represents the rolled strip, and 3 represents the measuring devices and sensors for the individual rolls 1 and their drives as well for other function blocks, e.g. for the nip, etc. The regulators and positioning devices for the rolls are designated 3*a*.

The measured values of the measuring devices and sensors 3 are adjusted at 4 after which they pass to statistical measured value protection device 5. Using these values, the sampling plan is recalculated at 6 and the algorithms used for the sampling plan recalculation are adapted at 7. The values from 7 are transferred in 9 to the sampling plan calculation which determines, among other things, the roll separating force, rolling torque, especially the section, but also the adjustment. The sampling plan calculation includes the data from the rolling strategy summarized at 8, which is formulated, in particular, from the type of material, finished thickness, and specified section as well as additional operator and computer data. The sampling plan calculation 9 provides the setpoint selection values calculated in 10 and fed to the individual regulators and positioning devices 3*a* for the individual working point regulators.

The function blocks shown in FIG. 1 are advantageously combined in a computer. However it is also possible to perform such processing in separate computers or in separate pans of one computer. Suitable computers in which the computations for the individual regulators can be performed are known. Their programming as well as a parameterization of the individual regulators is based on operating handbooks of such known computers.

Figure 2:
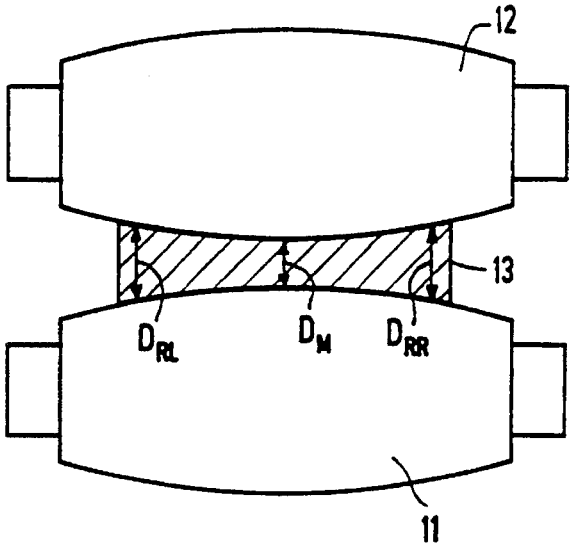
FIG. 2 is a schematic representation of the work rolls of a rolling mill stand.

In FIG. 2, reference 11 refers to a lower work roll, 12 to an upper work roll, and 13 to the rolled strip. The schematic representation does not account for the roll deflection produced by the influence of the roll separating force opposed to the strip shape shown, but indicates the theoretical convex shape (camber) of the work rolls. The strip has edge thicknesses $D_{RR}$ and $D_{RL}$ and a thickness $D_M$ at the center. The edge thickness, for example ($C_{40}$) is measured at the strip edge used. The section value P for the calculation is obtained from the relationship $P = D_M - (D_{RR} + D_{RL})/2$ and is normally expressed in microns. The respective special section development follows the requirements of the downstream cold rolling mill train or the requirements for the hot strip produced.

Figure 3:
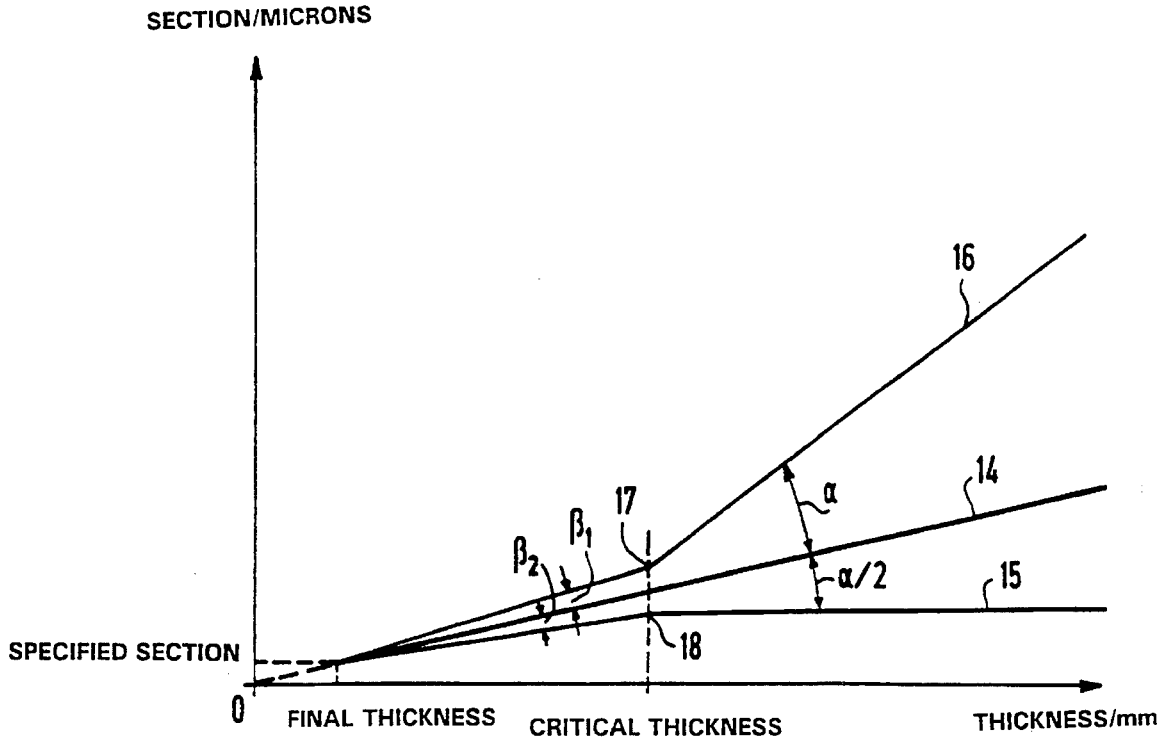
FIG. 3 illustrates shape control lines and their tolerance range.

In FIG. 3, reference 14 refers to the shape control line with lower tolerance limit 15 and upper tolerance limit 16. At points 17 and 18, which lie in the area of critical thickness, below which the material flow in the transverse direction can only occur within very narrow limits, the pitch of limiting curves 15 and 16 changes. The limiting curves 15 and 16 define a "shape funnel" which has the symmetric tolerance limit angle $\beta$ below the critical thickness. Above the critical thickness has the tolerance limiting angle $\alpha$ upward from the space control line 14 and $\alpha/2$ downward from the shape control line 14. This simplified definition of the "shape funnel" is especially favorable from the computational standpoint and is sufficiently accurate as well.

As may be seen, shape control line 14 runs through the zero point when extended. The working points may be adjusted so long as they remain within tolerance limit curves 15 and 16. The specified section and final thickness are specified by shape control line 14. The influence of the roll separating force is the main factor affecting random reduction. Other influential parameters involved in rolling technology on the other hand become less important and constitute only auxiliary parameters. Redistribution of the roll separating force therefore constitutes the essential factor for the section and thickness that are obtained. The basic condition is the maintenance of the total roll separating force, i.e., the total reduction required.

Below the critical thickness, the strip section obtained acts directly on the flatness of the strip during subsequent processing, so that it too is predetermined by the thickness of the strip and the strip section with only minor opportunities for influence.

We claim:

1. In a multi-stand, hot-strip, rolling mill for manufacturing a hot strip having a critical thickness below which material flow in a direction transverse to a roll can only occur within very narrow limits, the rolling mill including a plurality of individual roll stands, each of the roll stands being regulated by regulators, and having parameters measured by measuring devices, including a sample plan determination device being provided with initial and final dimensions, with material data, and with rolling temperatures, and adapted to determine a sampling plan for controlling the regulators, and including a processor which uses model equations with convergent parameter adjustment to actual parameters being used to determine setpoints of the regulators, a process for predefining a working point control, comprising steps of:

a) predefining a shape control line as a function of a final thickness of the hot strip at a specified section;

b) predefining a tolerance range for said shape control line, wherein said predefined tolerance range is narrower below the critical thickness than above the critical thickness;

c) adopting a working point control if all working points defining the working point control lie within the predefined tolerance range; and d) changing load distribution at the plurality of individual roll stands if at least one of the working points lies outside of the predefined tolerance range.

2. The process of claim 1 wherein said predefined tolerance range is defined by a deviation angle alpha above the critical thickness and a deviation angle beta below the critical thickness, alpha being greater than beta.

3. The process of claim 2 wherein the deviation angles alpha and beta define a shape funnel having a throat at the critical thickness.

4. The process of claim 3 wherein the shape funnel is symmetrical to the shape control line in an area below the critical thickness and asymmetrical to the shape control line in an area above the critical thickness.

5. The process of claim 4 wherein the deviation angle alpha defined by an upper limit of the tolerance range above the shape control line is approximately twice a deviation angle defined by a lower limit of the tolerance range below the shape control line.

6. The process of claim 1 further comprising a step of calculating the shape control line with data of a final section of a hot strip desired to be produced.

7. The process of claim 6 further comprising a step of recalculating the data of the final section if working points lie outside the tolerance range.

8. The process of claim 1 further comprising a step of exerting an influence on roll re-deflection if at least one of the working points lies outside of the predefined tolerance range.

9. The process of claim 1 further comprising a step of exerting an influence on at least one of a group consisting of roll displacement and roll transposition if at least one of the working points lies outside of the predefined tolerance range.

10. The process of claim 1 further comprising a step of changing a roll microsection if at least one of the working points lies outside of the predefined tolerance range.

11. The process of claim 1 further comprising a step of influencing a thermal change in convexity if at least one of the working points lies outside of the predefined tolerance range.

12. The process of claim 1 further comprising a step of redistributing a roll separating force of the individual stands based on ideal shape control lines.

13. The process of claim 1 further comprising a step of calculating a distribution of individual roll separating forces in a shape funnel based on a shape control line in an optimizing computer to achieve a total roll separation force required for a rolling mill train.

* * * * *